US005651663A

United States Patent [19]

Plüss

[11] Patent Number: 5,651,663

[45] Date of Patent: Jul. 29, 1997

[54] SAFETY DEVICE FOR A PUMP FOR INSTALLATION IN LINES FOR LIQUIDS, ESPECIALLY WATER, AND A DEVICE FOR DELIVERING LIQUID

[75] Inventor: Heinz Plüss, Schönbühl-Urtenen, Switzerland

[73] Assignee: Digmesa AG, Schonbuhl-Urtenen

[21] Appl. No.: 418,608

[22] Filed: Apr. 7, 1995

[30] Foreign Application Priority Data

Apr. 8, 1994 [DE] Germany ..... 44 12 045.1

[51] Int. Cl.[6] ..... F04B 49/00

[52] U.S. Cl. ..... 417/20; 417/43; 73/714; 73/861.77; 222/129.1

[58] Field of Search ..... 417/20, 43, 44.2, 417/44.4; 73/700, 714, 861.77, 861.78; 222/59, 129.1

[56] References Cited

U.S. PATENT DOCUMENTS

| | | | |
|---|---|---|---|
| 2,462,019 | 2/1949 | Bowman . | |
| 4,172,381 | 10/1979 | Aigner | 73/229 |
| 4,306,457 | 12/1981 | Fukui et al. | 73/861.77 |
| 4,345,480 | 8/1982 | Basham et al. | 73/861.77 |
| 4,848,164 | 7/1989 | Quarve et al. | 73/861.77 |
| 5,447,062 | 9/1995 | Kopl et al. | 73/861.78 |

FOREIGN PATENT DOCUMENTS

| | | |
|---|---|---|
| 509602 | 10/1992 | European Pat. Off. . |
| 2230836 | 6/1972 | Germany . |
| 2439789 | 8/1974 | Germany . |
| 3442358 | 11/1984 | Germany . |
| 3608298 | 3/1986 | Germany . |

*Primary Examiner*—Michael Koczo
*Assistant Examiner*—Xuan M. Thai
*Attorney, Agent, or Firm*—Antonelli, Terry, Stout & Kraus, LLP

[57] ABSTRACT

In order to create a safety device (1) by means of which reliable protection of the pump can be achieved as simply as possible, it is proposed that safety device (1) have a housing (4) provided with an inlet (5) and an outlet, inside which housing a first detection device with a transmitter element in the form of an impeller (7) provided with measuring blades (9) and a central part (10) are provided to determine the liquid throughput and a second detection device (24) in the form of a probe for detecting the liquid, both of which are connected with a control device for the pump.

18 Claims, 2 Drawing Sheets

SAFETY DEVICE FOR A PUMP FOR INSTALLATION IN LINES FOR LIQUIDS, ESPECIALLY WATER, AND A DEVICE FOR DELIVERING LIQUID

BACKGROUND OF THE INVENTION

1. Field of the Invention

The invention relates to a safety device for installation in lines for liquids, especially water, a beverage preparation device, with the pump delivering liquid into a container, and a device for delivering liquid, with a pump in a liquid line.

2. Description of the Prior Art

In a known beverage preparation device for preparing water containing carbon dioxide, "soda water," prepared or unprepared drinking water, but drinking water in particular, is raised to a high pressure by means of a pump and sprayed through a nozzle into a tank filled at least half way with carbon dioxide gas ($CO_2$). The resultant water containing carbonic acid collects in the bottom half of the tank. Inside the tank there are two probes of different lengths, connected to a control device that switches the pump on and off. As soon as the liquid level reaches the shorter, upper probe, the pump is switched off. The water containing carbonic acid can escape through a drain cock located in the lower half of the tank. When the longer probe emerges from the surface of the liquid, the pump is switched on again after a brief delay of approximately 1 to 2 seconds. The pump again delivers water to the tank and the liquid level rises again until the upper probe is reached and the pump is switched off again.

The pump is the most sensitive part of this beverage preparation device, the pump frequently being a vane pump. For example if there is no longer any water in the line, the pump will run dry, causing it to break down relatively rapidly. To protect the vane pump against failure, the pressure is, for example measured, upstream and downstream of the pump. If the measured pressure differential does not reach a preset level, the control will switch off the pump. In addition, a heat sensor is mounted partly on the pump so that when a preset temperature is exceeded, the pump is also shut off. However, one disadvantage of this arrangement is that if the supply of drinking water is shut off because the level in the carbonic acid tank is too high, producing excessive pressure on the discharge side of the pump, i.e. the pressure differential between the input and output sides exceeds the preset level, the pump will deliver the water through its own pressure adjustment and overflow system in the circuit. Delivery into the tank is then no longer possible, however. In addition, in this device the pressure must be measured upstream and downstream of the pump. This is expensive since two pressure-measuring devices are required for the purpose, one upstream of the pump and the other downstream of the pump. In addition, a third measuring device is required for heat measurement.

SUMMARY OF THE INVENTION

Hence, the goal of the invention, of avoiding the above-mentioned disadvantages, is to provide a safety device of the type described above by which reliable protection can be provided for the pump in as simple a manner as possible.

According to the invention, this goal is achieved in a device of the type described above by a housing with a through-flow chamber having an inlet and an outlet, a detector device with a sensor located in the through-flow chamber in the form of an impeller provided with measuring blades and a central part, and with a first detector element for determining the throughput of the liquid, a second detector device in the form of a probe for detecting the presence of liquid, and by a control device connected with both detector devices for the pump. A device according to the invention for delivering liquid has a throughput meter located in the liquid line, directly at the pump, inside which meter a first measuring body in the form of an impeller provided with measuring blades and a central part for determining the throughput of liquid and a second measuring body in the form of a probe for detecting the liquid, with both measuring bodies being connected with a control device for the pump in order to stop the pump in the absence of liquid or with insufficient liquid throughput in the through-flow chamber. As a result of this design according to the invention, it is possible at any time during operation to determine whether drinking water is being delivered and whether drinking water is present in the line. With the aid of these determinations, it is then possible to switch off the pump at any time as soon as one of these two conditions regarding delivery and presence of water in the line no longer exists. In addition, only a single safety device is required for performing these determinations.

In order to make the safety device as compact as possible, improvements on the invention provide that the housing has an upper part to receive the probe and a lower part to receive the impeller. The probe is preferably located in the housing, to the side of the central part of the impeller and above its measuring blades. In addition, the probe is preferably located between the central part of the impeller and the inlet and/or outlet of the housing. In this manner, a safety device is created in which the detection devices required to protect the pump can be mounted optimally with limited space requirements.

The probe in a preferred design is a probe screw located inside an insulating sleeve. The insulating sleeve in turn is located inside a bore that passes through the upper part of the housing. In addition, improvements of the invention provide for the probe screw to be mounted by means of a nut at the end of the bore facing away from the lower part of the housing. For this purpose, the housing upper part preferably has a pot-shaped interior chamber at the end facing away from the lower part of the housing. In this manner, the detection devices as well as other connections can be mounted in a very limited space without taking up much room inside the safety device.

The cylindrical interior chamber is preferably sealed at the top by means of a lid. In order to create a connection with the control device, the lid has a four-pole plug connection in the form of four plug blades as well as a bore with a threaded sleeve located between the plug blades and closed on the bottom.

In order to conduct pulses measured by the probe to the control device, the probe screw is connected with the lid and with one of the plug blades.

In order to determine as simply as possible whether or not delivery and hence throughput are taking place, provision is in the preferred embodiment the impeller is provided in its central part with permanent magnets that are in contact by proximity with a stationary Hall cell located in a recess in the bottom of the cylindrical interior of the upper part of the housing. As a result, by means of the Hall effect, with zero contact and without interaction, a scanning system is created in simple fashion so that the pump can be protected efficiently and simply against running dry. To conduct the pulses measured by means of the Hall effect to the control device, the Hall cell, like the probe, is connected with the control device by the plug connection.

A safety device is created on the basis of these designs according to the invention which, by integrating two measuring bodies, namely the impeller with the Hall cell and permanent magnet as well as the probe, creates within a housing, detection devices that are compact and take up little space, so that optimum pump protection can be provided simply and effectively. It is merely necessary to have a safety device to perform the checks required for protecting the pump, even when the latter has two detection devices, which are however designed to be integrated into the safety device. Pressure measurement upstream and downstream of the pump and pump temperature measurement are no longer required. Hence, the number of necessary safety devices is reduced to one, which in the preferred embodiment can be located in the feed to the pump for example, but can also be located downstream from the pump for performing the measurements. When the safety device is located in the feed to the pump, it can rapidly determine whether the pump is delivering anything by opening an existing overpressure valve in the circuit and can then shut off the pump by means of the control device.

The pulses measured by the throughput detector or the probe are fed through corresponding connections to the control device and evaluated therein, so that the pump can immediately be shut off directly by means of the control device if one of the two pulses is absent, either the pulses from the Hall cell or those from the probe. The pump is therefore shut off either when delivery is no longer possible or when water is no longer present and the pump is delivering air.

BRIEF DESCRIPTION OF THE DRAWINGS

Further advantages and features of the invention will be evident from the claims and the following description in which one embodiment of the invention is described in detail with reference to the drawing.

Figure 1:
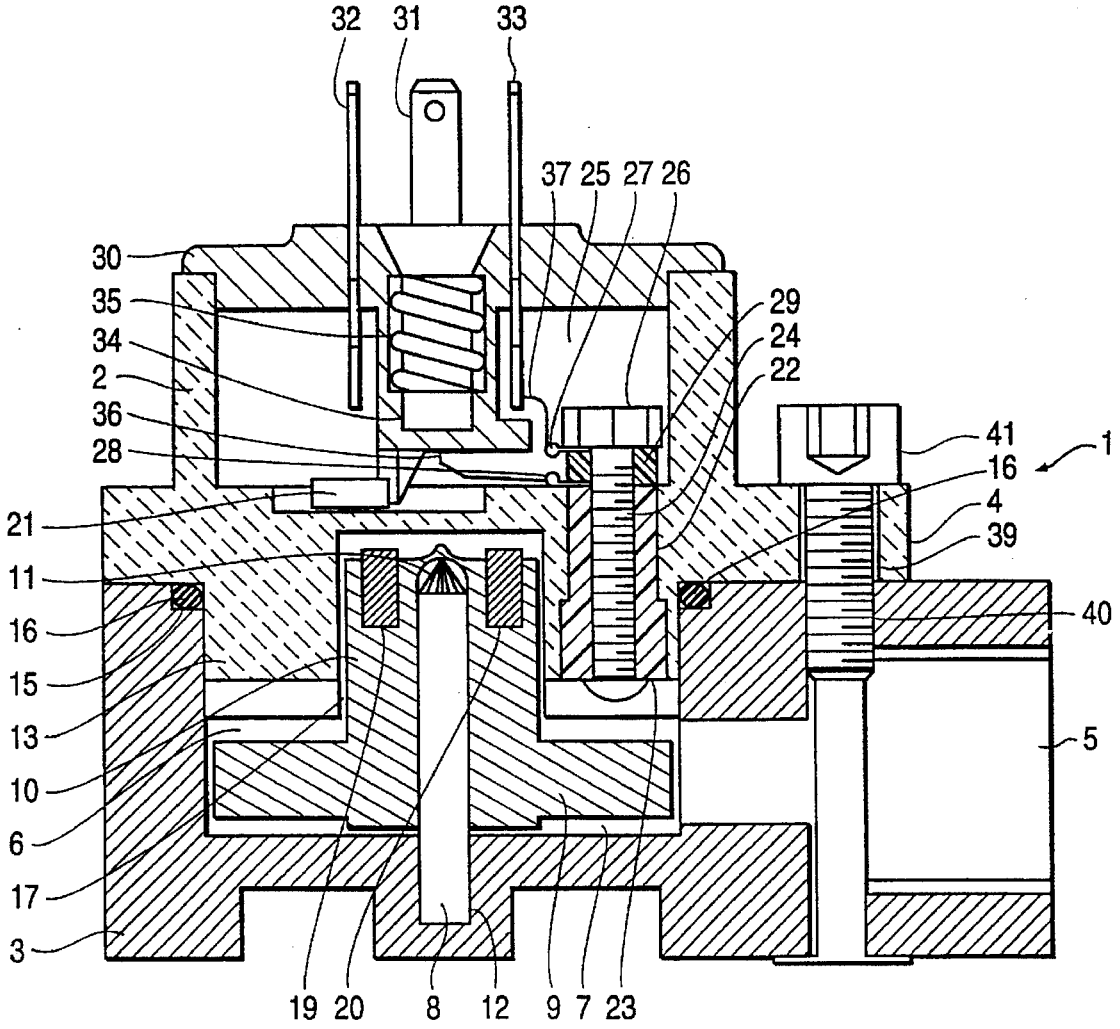
FIG. 1 shows the important parts of the safety device according to the invention, in cross section.

The safety device 1 shown in FIG. 1 has a housing 4 composed of an upper part 2 and a lower part 3. Housing lower part 3 has two openings located side by side (only one can be seen in FIG. 1), which serve as an inlet opening 5 and an outlet opening. In addition, housing lower part 3 is provided with a through-flow chamber in the shape of a cylindrical shaped cavity 6, sealed at its bottom and left open at its top. Cylindrical chamber 6 of housing lower part 3 serves to receive an impeller 7, caused to rotate by the liquid flowing through lower part 3 of housing 4. Impeller 7 is rotatably mounted by means of a bearing pin 8. For this purpose, impeller 7, in a central part 10, has a bore 11 that extends for nearly the entire length of central part 10. A recess 12 is correspondingly provided in housing lower part 3, in which recess bearing pin 8 is mounted by its lower side. Impeller 7 with central part 10, as well as measuring blades 9 radially surrounding central part 10, is placed in lower part 3 of housing 4, carefully centerable by means of bearing pin 8, and then held in a sufficiently centered position so that housing upper part 2 can easily be placed on top of housing lower part 3.

Housing upper part 2 has a projection 13 extending annularly downward, by means of which upper part 2 can be inserted into cylindrical shaped cavity 6 of lower part 3. To seal the space between upper and lower parts 2 and 3, lower part 3 has a circumferential recess 15 into which an O-ring 16 is inserted to provide a seal between upper and lower parts 2 and 3 of the housing. Within annular projection 13 of upper part 2, a circular cylindrical shaped cavity 17 is formed that serves to receive the upper part of central part 10.

Cylindrical shaped cavity 6 and cylindrical shaped cavity 17 are designed so that there is sufficient radial play between impeller 7 and the inside wall of housing 4.

Impeller 7 has permanent magnets 19 and 20 in its central part 10, at the end facing housing upper part 2. These magnets are in contact by proximity with a stationary Hall cell 21 located in a recess in housing upper part 2. The impeller forms a part of a first detector element of the safety device. This and the Hall probe comprise the first detector device.

Projection 13 between impeller 7 and inlet 5 or the outlet of safety device 1 is provided with a bore 22 passing through housing upper part 2. Within this bore 22 is an insulating sleeve 23 inside which a probe screw 24 is in turn provided. To secure probe screw 24, a nut 26 is provided in a cylindrical shaped interior chamber 25, open at the top, of housing upper part 2, at the end facing away from housing lower part 3. Two contacts 27, 28 are provided below nut 26, the contacts being insulated from one another by means of an insulating washer 29 surrounding insulating sleeve 23.

Cylindrical shaped interior chamber 25 is sealed at its top by means of a lid 30. Lid 30 has a four-pole plug connector, for electrical connection of detector device 7, 21; 24 with a control device 51, in the form of four plug blades 31, 32, 33 (only three are shown in FIG. 1), as well as a bore 34 closed at the bottom and formed between the four plug blades 31, 32, 33, with a threaded sleeve 35. The fourth plug blade is located opposite the plane of the sectioned view of plug blade 31. Probe screw 24 is connected by wires 36, 37 with plug blades 31, 33. Both the ground of contact 28 and the ground of Hall cell 21 are connected to plug blade 31 by wire 36. Threaded sleeve 35 serves to fasten a magnet receptacle, not shown.

Housing upper part 2 as well as housing lower part 3 have, at inlet and outlet sides 5, a plurality of through bores 39, 40 flush with one another, to receive fillister-head screws 41. The housing upper and lower parts 2 and 3 are bolted together by means of screws 41.

If a liquid, especially water, flows through lower part 3 of housing 4, impeller 7 is set rotating by this liquid and produces a Hall voltage in Hall cell 21 by means of permanent magnets 19, 20 mounted in the impeller. The detection pulses thus produced are fed to a control device 51 (see FIG. 2), not shown in FIG. 1, and evaluated there. In addition, a detection pulse is sent to the control device through probe 24 when a liquid flows through housing lower part 3. If one of these two detection pulses is missing, the pump controlled by the control device (see FIG. 2 is switched off.

It is only when detection pulses are received from both detection devices 7, 21; 24 that the pump is switched on again or simply continues to operate. The detection devices are therefore connected electrically by a logical AND function or an AND circuit in the control device.

Figure 2:
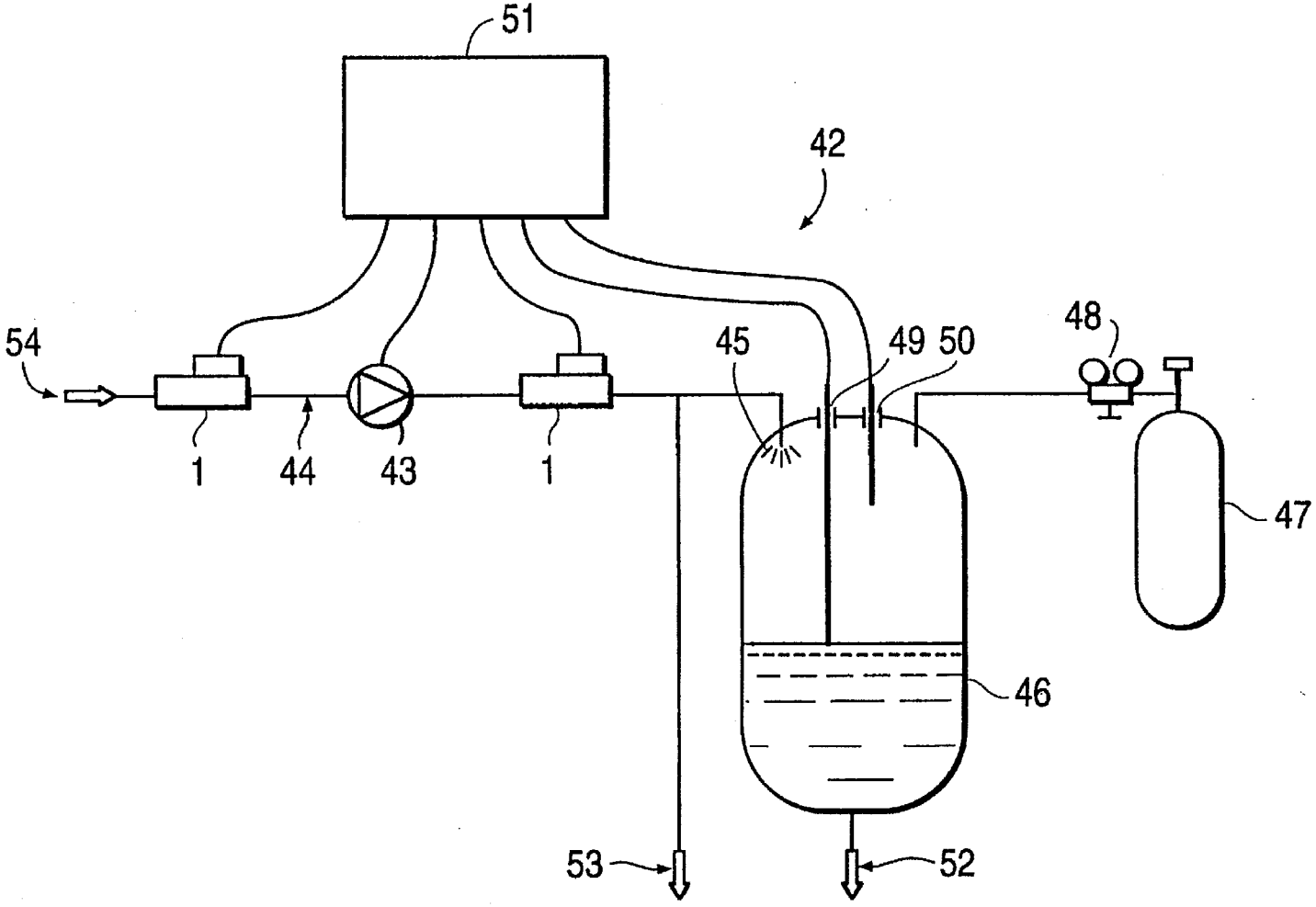
FIG. 2 shows the arrangement of the device according to the invention with the safety device inside a beverage preparation device.

FIG. 2 shows the arrangement of the device according to the invention with safety device 1 inside a beverage preparation device 42 for creating water containing carbonic acid. The device according to the invention has a pump 43, especially a vane pump. This vane pump advantageously has safety device 1 connected to it upstream. Drinking water flowing in a line 44 is raised to a high pressure by pump 43 and conducted to a nozzle 45. The drinking water is then sprayed from this nozzle 45 into a container, especially a tank 46, filled at least half way with carbon dioxide gas for producing water containing carbonic acid. This carbon dioxide gas comes from a suitable container 47 and is fed to tank 46 through valves 48. Inside tank 46 are two probes 49, 50 of different lengths, insulated from the tank and likewise isolated from electrical ground. These probes 49, 50 as well as pump 43 and measuring device 1 are each connected with a control device 51. Pump 51 is switched on and off by this control device 51.

A drain cock 52 is mounted on the bottom of tank 46, through which cock water containing carbon dioxide can be removed from tank 46. Another drain cock 53 is located upstream of nozzle 45, through which water not mixed with "carbonic acid," so-called "non-carbonated water," can be removed from beverage preparation device 42.

The beverage preparation device 42 for producing water containing carbonic acid has the following function:

The drinking water from a supply 54, after passing through pump 43, passes through safety device 1. The drinking water is raised to a corresponding set pressure by pump 43 and delivered to a nozzle 45 or a drain cock 53. Corresponding pulses are delivered to control device 51 by the probe and the throughput meter when water is flowing through safety device 1. If the pulses from one of these two detection devices are absent, control device 51 will switch off pump 43. When pulses are again received from these two detection devices, pump 53 will be switched on again. The water sprayed by nozzle 45 into tank 46, in the form of a mist, dissolves the carbon dioxide supplied from container 47 to tank 46. In the lower half of tank 46, the water containing carbonic acid, called "soda water," then collects and can then be removed from the tank through drain cock 52. The carbonic acid containing water thus produced can now be sold directly or used to prepare "post-mix" beverages, including beverages made with syrup and water containing carbonic acid. In addition, a measuring device located downstream from pump 43 is shown in FIG. 2, which device can also perform the function described in order to increase safety.

Probes 49, 50 located in tank 46 serve to control the liquid level in tank 46. If the liquid level reaches shorter upper probe 50, a corresponding signal is transmitted to control device 51 to shut off the pump. Since the entire system is permanently under pressure, the water containing carbonic acid is then dispensed through drain cock 52. When longer lower probe 49 emerges from the liquid, a corresponding pulse is transmitted to control device 51 to turn on pump 43 once more after a delay of 1 to 2 seconds. Water containing carbonic acid is produced once again, and the liquid level can again rise to upper probe 50.

Thus, a safety device is created according to the invention that provides pump protection in a simple and reliable fashion without costly measurements being required for the purpose.

I claim:

1. A safety device for use with a pump installed in line conveying liquid in a beverage preparation machine comprising:

a measuring device for installation in the line connected with the pump, the measuring device having a housing having a through-flow chamber having an inlet and an outlet;

a first detector provided in the measuring device for determining a through-flow rate of the liquid with a rotary impeller located in the through-flow chamber and with a detector element mounted on the housing;

a second detector in the form of a probe for measuring conductivity of the liquid in the line to detect the presence of the liquid in the line; and a control device, connected with the first and second detectors and with the pump, the control device delivering a control signal to the pump to stop the pump when a signal from the first detector indicates that a first rate of the liquid is too low or a signal from the second detector indicates that there is no liquid in the line.

2. A safety device according to claim 1 wherein:

the probe is located in an inlet area of the through-flow chamber.

3. A safety device according to claim 1 wherein:

the probe is located laterally in the housing with respect to a central part of the rotary impeller and above blades of the impeller.

4. A safety device in accordance with claim 3 wherein:

the probe is located between the central part of the rotary impeller and one of the inlet or outlet.

5. A safety device in accordance with claim 1 wherein:

the probe is a probe screw located inside an insulating sleeve.

6. A safety device in accordance with claim 5 wherein:

the insulating sleeve is located inside a bore passing through an upper part of the housing.

7. A safety device in accordance with claim 5 wherein:

the probe screw is mounted on an end of a bore that faces away from a lower part of the housing by means of a nut.

8. A safety device in accordance with claim 1 wherein:

an upper part of the housing has a cylindrical shaped interior chamber facing away from a lower part of the housing.

9. A safety device in accordance with claim 8 wherein:

the cylindrical shaped interior chamber is sealed at a top thereof by means of a lid.

10. A safety device in accordance with claim 9 wherein:

the lid has a four-pole plug connection having four plug blades for electrical connection of measuring bodies with the control device, and a bore with a threaded sleeve, the bore being closed at a bottom thereof and located between the four plug blades.

11. A safety device in accordance with claim 10 wherein:

the probe is a probe screw connected with the lid and with one of the four plug blades.

12. A safety device in accordance with claim 1 wherein:

a central part of the impeller has permanent magnets, the permanent magnets being magnetically coupled by proximity with the detector element which is a stationary Hall cell located in a recess in a bottom of a cylindrical interior chamber of an upper part of the housing.

13. A safety device in accordance with claim 12 wherein:

the Hall cell is connected by a plug connection with a control device.

14. A safety device in accordance with claim 1 wherein:

the probe is located in the through-flow chamber.

15. A safety device in accordance with claim 1 wherein:

the housing has an upper part receiving the probe and a lower part receiving the impeller.

16. A safety device in accordance with claim 1 wherein:

the measuring device is connected upstream of the pump.

17. A safety device in accordance with claim 1 wherein:

the measuring device is connected downstream of the pump.

18. A device for delivering liquid to a beverage preparation device having a pump located in a liquid line comprising:

a measuring device for installation in the liquid line connected with the pump, the measuring device having a housing having a through-flow chamber having an inlet and an outlet;

a first detector provided in the measuring device for determining a through-flow rate of the liquid with a rotary impeller located in the through-flow chamber and a detector element mounted on the housing;

a second detector in the form of a probe for measuring conductivity of liquid in the line to detect the presence of the liquid in the line; and a control device connected to the first and second detectors and to the pump, the control device transmitting a control signal to the pump to stop the pump when a signal from the first detector indicates a through-flow rate that is too low or a signal from the second detector indicates that there is no liquid in the line.

* * * * *

UNITED STATES PATENT AND TRADEMARK OFFICE

CERTIFICATE OF CORRECTION

PATENT NO. : 5,651,663

DATED : July 29, 1997

INVENTOR(S) : H. PLUSS

It is certified that error appears in the above-indentified patent and that said Letters Patent is hereby corrected as shown below:

Please correct the Assignees address on the cover page as follows: --Biel, Switzerland--.

Signed and Sealed this

Thirtieth Day of September, 1997

*Attest:*

Bruce Lehman

BRUCE LEHMAN

*Attesting Officer*

*Commissioner of Patents and Trademarks*